United States Patent [19]

Elder

[11] 3,937,428

[45] Feb. 10, 1976

[54] ROUTE INTERLOCKING CONTROL SYSTEM

[75] Inventor: J. Calvin Elder, Penn Hills, Pa.

[73] Assignee: Westinghouse Air Brake Company, Swissvale, Pa.

[22] Filed: Feb. 6, 1975

[21] Appl. No.: 547,702

[52] U.S. Cl. ..... 246/34 R; 246/134

[51] Int. Cl.[2] ..... B61L 19/16

[58] Field of Search ..... 246/34 R, 34 CT, 134, 131, 246/146, 106, 25

[56] References Cited

UNITED STATES PATENTS

| | | | |
|---|---|---|---|
| 2,207,079 | 7/1940 | Thompson | 246/134 |
| 2,247,801 | 7/1941 | Caille | 246/134 |
| 2,280,891 | 4/1942 | Caille | 246/134 |

*Primary Examiner*—Trygve M. Blix
*Assistant Examiner*—Reinhard J. Eisenzopf
*Attorney, Agent, or Firm*—A. G. Williamson, Jr.; R. W. McIntire, Jr.

[57] ABSTRACT

A single relay serves to register route request selections for both traffic directions over each track route through a railroad interlocking layout. This single route request relay is jointly controlled by the route selection push buttons for both directions, the actuated push button being also repeated by a traffic direction relay. The route request relay pick up checks that no conflicting route request is active, and that the same or opposing route is not already established and locked. The route request and direction repeater relays are held by stick circuits to store the request until the route is locked. A single relay serves to provide the clear and lock function for all possible traffic routes originating at each entry point into the interlocking. Each clear and lock relay responds to the registry of a route request originating at that location but also checks, in accordance with the route switch positions, that the opposing approach lock relay is still picked up, that the involved track sections within the interlocking are unoccupied, and the absence of cab signal energy for an opposing train within the interlocking. The clear/lock relay selects and enables the clearing of the correct route entry signal, releases the route request storage, and locks the established route against any opposing route requests. Cancellation of a route request or a locked route with cleared signal is provided, with separate actions as the approach track is or is not occupied. Cancellation of a locked route and cleared signal requires the usual time delay to assure that an approaching train stops short before a conflicting move is authorized.

14 Claims, 4 Drawing Figures

ROUTE INTERLOCKING CONTROL SYSTEM

BACKGROUND OF THE INVENTION

My invention relates to a route interlocking control system for railroads. More specifically, the invention relates to a system in which a single route request relay controls both directions of traffic through a railroad interlocking along each possible track route and a single route locking relay for each entrance location to the interlocking locks up each possible route originating at that entry point, when established, and selects and enables the clearing of the proper entry signal.

In developing interlocking control systems for rapid transit railroads, it is desirable to reduce the operations required of the system operator in controlling the routing of trains. Thus a route type interlocking control system, requiring the operation of only one selector or circuit controller device to establish each route, is preferable. It is also desirable to use a minimum amount of apparatus in any interlocking control system. In other words, a specific route interlocking system should be designed to use the fewest number of relays possible to accomplish the stated purpose and provide all specified features. One possible manner of conserving relays in such a system is to use only one relay to request and initiate the establishment of traffic in either direction over each possible track route or lineup through the interlocking. A second possible point of saving is to use a single relay to lock all possible routes originating from a specific entry point when requested and aligned and to also control or enable the selection and clearing of the entry signal at the established entrance end of the lined route. By accomplishing these two points, additional savings are then possible in the apparatus involved in the various indication circuits and secondary control networks.

Accordingly, an object of my invention is an improved interlocking control system for rapid transit railroads.

Another object of the invention is a route interlocking control system using only one route request relay for establishing either direction of traffic along each possible track route through an interlocking layout.

Still another object of the invention is a control system for a railroad interlocking requiring only a single push button to select each desired route and a single relay to register a request for the desired route or at other times for the identical opposite route through the track layout.

A further object of my invention is an improved railroad route interlocking control system using a single route request relay for either traffic direction along each possible track route through the interlocking and a single clear and lock relay at each possible entrance to the interlocking to lock up any established route originating at that entry point and to enable the clearing of the proper signal authorizing the train to traverse the established route.

Yet another object of the invention is a route type interlocking control system for railroads in which a single route request relay serves both directions for each track routing, a single clear and lock relay serves all routes originating at each entry location, and separate route cancellation controls are provided for the approach clear and occupied conditions of the established route.

Other objects, features, and advantages of my invention will become apparent from the following specification when taken in connection with the accompanying drawings and appended claims.

SUMMARY OF THE INVENTION

At the control location of an interlocking system which embodies my invention, a control machine including a track diagram of the interlocking layout and a control device console or panel is provided. This console includes a selector switch or push button type circuit controller for each route through the interlocking layout, a specific route cancel switch for each entry location, and common cancel switches to select between the occupied and clear condition of the approach track to the route being cancelled. The operation of the route selection device, actually shown as a push button, actuates a route request relay and a direct repeater of the selector device. The same route request relay is also actuated if the selector push button for the route in the exact opposite direction through the same track lineup is activated but a different repeater relay is provided for each selector push button device. Each repeater relay in effect designates the entry and/or exit points of the desired route, that is, the direction in which the train will move through the route selected. The circuit network for each request relay checks whether or not a conflicting route has also been requested. It further checks whether the same or exactly opposite route is already cleared and locked and the absence of any cancellation action. The actuated route request relay together with the specific push button repeater relay, that is, the selector device repeater, select the route clearing and locking relay which locks the route and enables the clearing of the entry or home signal to authorize a train movement through the established route. The circuit network for each clear and locking relay checks the opposing approach lock relay, the switch positions for the requested route, and the route occupancy conditions. The actuated clear and lock relay selects the entry or home signal to be cleared in accordance with the position of the switches included in the established route and enables the circuit network for that signal to display a proceed indication. This signal clearing network further checks, although not specifically shown, the advance traffic conditions along the established route and its extended pathway beyond the interlocking.

Thus the system operator selects or activates a route request push button which selects the route request relay applicable for both directions through the desired track route. In addition, a push button repeater relay unique for the activated route selection push button is energized to designate the traffic direction through the selected route. These actions do not complete if a conflicting route has just been selected and is in the process of being established or if the opposite or same route is already cleared and locked. Under certain conditions, if a conflicting route had been previously requested and is now cleared and locked, the present route request may be stored by the route request relay pending system reset to conditions which will allow the full route to be established and cleared. When the route request is registered and a specific route direction recorded, a clear and lock relay at the entrance of that route is energized and then holds in the picked up position. This action can occur only after a check is made that the opposite direction approach locking network has not been previously activated. This approach locking check is made in a manner determined by the route lineup, that is, by the position of the switches throughout this established route. The clear and lock relay selects, also in accordance with the switch positions, the specific signal to be cleared to authorize the train movement. At any any point in the operation, and even after the route has been established and locked with the signal cleared, the route and signal may be cancelled by the operator. This action is initiated by the operation of a specific route cancellation push button and one of two common route cancellation devices, depending upon whether the approach to the established route is clear or occupied. Since the route operator has knowledge as to the condition of the route approaches, the specific route cancellation button and the selected common system button which he operates will be in accordance with the known track conditions. If the route is already cleared and locked, as is normal a time delay is enforced after the cancellation request before a new route conflicting in any portion can be established.

BRIEF DESCRIPTION OF THE DRAWINGS

Before describing in detail the specific arrangement of my invention and defining the novelty in the appended claims, reference is made to the accompanying drawings in which:

Figure 1:
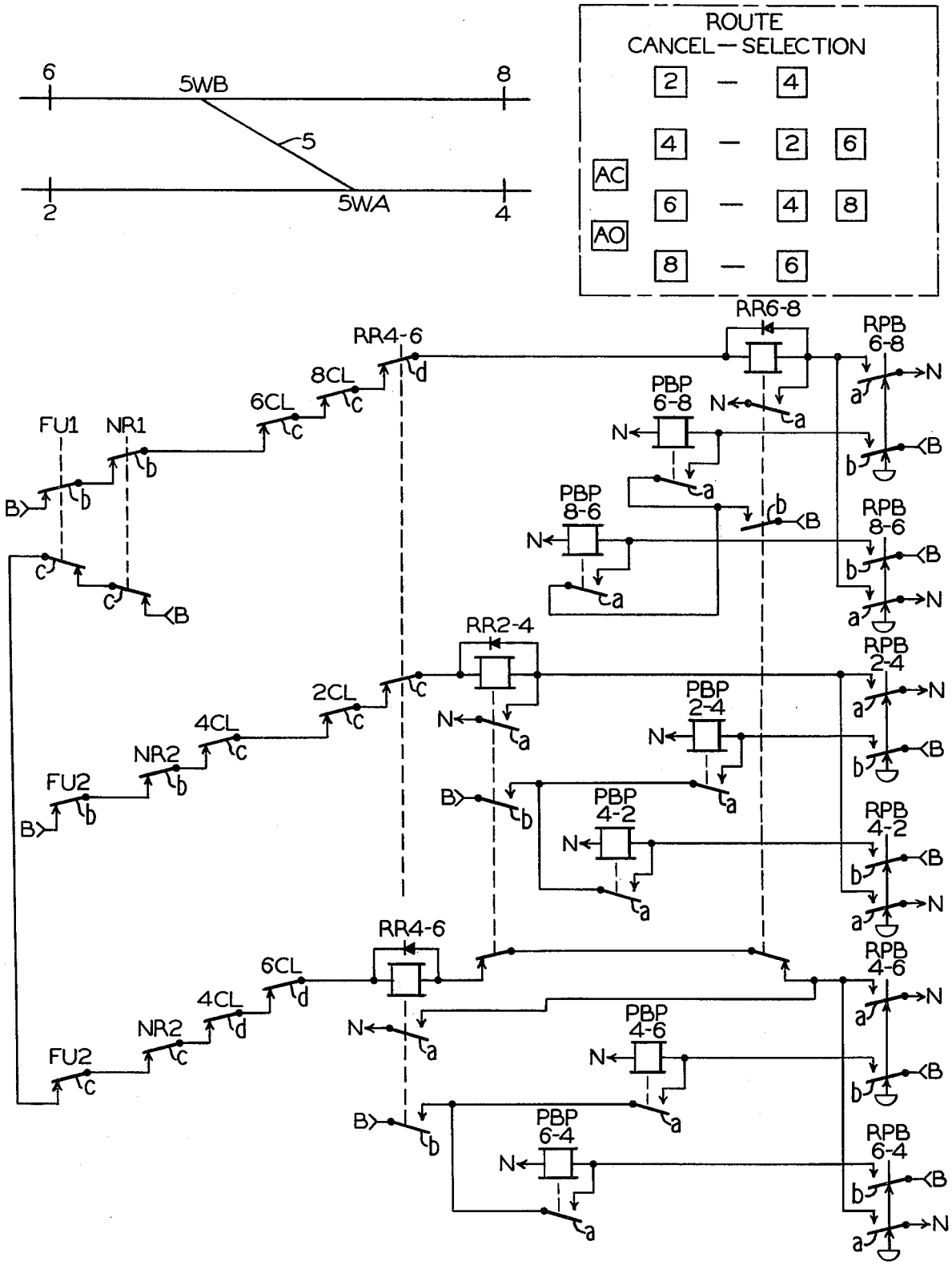
FIG. 1 is a partly schematic, partly circuit diagrammatic illustration of a control console and route request network of a route interlocking control system embodying my invention.

In each of the drawings, similar references designate similar parts of the apparatus. In these drawings, in general the relay contacts are shown in a vertical column above or below the symbol designating the relay winding. In each of such relays, the movable portion or the armature of a contact structure moves upward when the relay is energized to close against front contacts. When the relay windings are deenergized and any slow release period has expired, such relay armatures move to their lower position, that is, release, and close against the back contacts to complete the circuits there. However, for convenience in the drawings, certain contacts of some relays are shown on drawing figures other than that in which the conventional symbol for the relay winding and its control circuits are illustrated. Where contacts are thus remotely shown, they are designated by a reference the same as that applied to the relay winding symbol plus a lower case letter reference unique, for that relay, to that specific contact. All relay contacts are designated by a unique lower case letter reference whether or not they are shown in direct association with the winding symbol. For the system of my invention as illustrated, a source of direct current energy is provided for operating the various relays. Since the use of such direct current energy sources is conventional and any one of several types may be used, no specific illustration of the direct current energy source is shown. The positive and negative terminals of this energy source are designated, however, by the references B and N, respectively, wherever appearing in any of the drawings.

DETAILED DESCRIPTION OF THE ILLUSTRATED EMBODIMENT

Referring to FIG. 1, across the top in schematic representation is shown a control machine layout for a route interlocking control system. At the left is a simple track diagram of the controlled interlocking, which is a crossover between two main tracks, each shown by a single line representation. The entry and exit points are designated by the numerals 2, 4, 6, and 8, while the crossover 5 has switches at each designated 5WA and 5WB. This simple type of interlocking arrangement is sufficient to illustrate the features of my invention. Although not here shown for the sake of simplicity, it is well understood that various indications may be displayed as part of the track diagram, such as track occupancy conditions, switch positions and signal aspects, and established routes. Since the display of such indications is conventional in interlocking control systems, they are not here illustrated but the manner in which they may be provided will become obvious as the description proceeds. At the right, the dot-dash rectangle represents the control console or panel of the system. Each smaller solid square within the outer box designates a push button selector device with the designating numbers corresponding to the entry/exit points in the interlocking illustration.

In a left column, under the heading "CANCEL", are four push buttons representing each of the four entry points into the interlocking. The selected one of these push buttons is activated when it is desired to initiate the cancellation operation of a route originating at that entry point, whether already established through the interlocking or merely requested. Two additional push buttons under the same heading are the approach clear push button AC and the approach occupied push button AO. One of these common push buttons must be operated jointly with a route cancellation button to achieve the desired operation. They are selectively operated as the approach to the established route is clear or occupied, that is, the AC or AO push button. In the right hand portion of the control panel, under the title "SELECTION," are the push buttons which are operated when it is desired to establish a route through the interlocking. In the horizontal lines or rows, each of these buttons is numerically designated to show the exit point for a route from the corresponding entrance point designated by the cancel button. In other words, in the top row, the route selection push button 4 represents and is operated when it is desired to establish a route from the entry point 2 to the exit point 4 of the interlocking. Push button 4 and only push button 4 is operated to set up this desired route. It will be noted that, if it is desired rather to establish a route from entry point 4 to exit point 2, the push button 2 in the same row as the cancel button 4 will be operated.

The specific route selection push buttons corresponding to the selection portion of the control panel are shown by conventional circuit symbols in a vertical column at the right of the drawing. Each of these push buttons is of the spring return, push type having two normally open contacts *a* and *b*. Each of these push buttons is designated by the reference RPB with a combined numerical suffix designating the points between which the route is to be established. As an example, the uppermost push button is designated as RPB6-8 and is the push button activated when it is desired to establish a route from entry point 6 to exit point 8 in the interlocking. As another example, the lowest push button is designated RPB6-4 and designates that device operated when a route from point 6 to point 4 is to be established.

Each associated pair of route push buttons, that is, for selecting routes from opposite ends of the same track route lineup through the interlocking, controls a single route request relay RR. There are three such relays, each further defined by a numerical suffix which designates the ends of the track route lineup in numerical order but with no regard to route or traffic direction. Thus route request relay RR6-8 is associated with the track route between points 6 and 8 regardless of the direction of traffic movement. The energizing circuit for each route request relay, completed when one of the corresponding route push buttons is activated, further checks as to whether or not a conflicting route request is simultaneously being processed and whether or not a route has been established and locked from either end of the track lineup involved. The circuit also includes provisions for cancelling the route during the period when it is being established. For example, tracing the circuit network for relay RR6-8, one finds that it extends from terminal B of the local source over back contact *b* of an approach occupied cancellation relay FU1, back contact *b* of an approach clear cancellation relay NR1, back contacts *c* of the clear and lock relays 6CL and 8CL associated with each end of the corresponding track route, and back contact *d* of route request relay RR4-6, which is associated with a conflicting route, thence through the winding of relay RR6-8 and over contact *a* of push button RPB6-8 or contact *a* of push button RPB8-6 to terminal N. When relay RR6-8 is energized and picks up, the closing of its front contact *a* completes a stick circuit connection to terminal N which bypasses contact *a* of whichever associated push button RPB was operated.

Each route push button has a direct repeater relay PBP energized over contact *b* of that push button. Each repeater relay has a stick circuit which includes its own front contact *a* and front contact *b* of the associated route request relay. As an example, relay PBP6-8 is energized over front contact *b* of push button RPB6-8 when this contact is closed and then is retained energized over a stick circuit including front contact *b* of relay RR6-8. Each repeater relay has a numerical suffix in its reference which corresponds to that of the associated push button. These repeater relays define the traffic direction, that is, the entrance to exit direction for the established route designated by the energized route request relay RR. The purpose of this designation of direction will become apparent shortly. It is also to be noted that, under certain conditions, when a route relay is energized but, because of an established conflicting route, the completion of the route establishment cannot be carried forward, the stick circuit for the route relay retains the route request stored until such time as the route establishment is possible.

Figure 2:
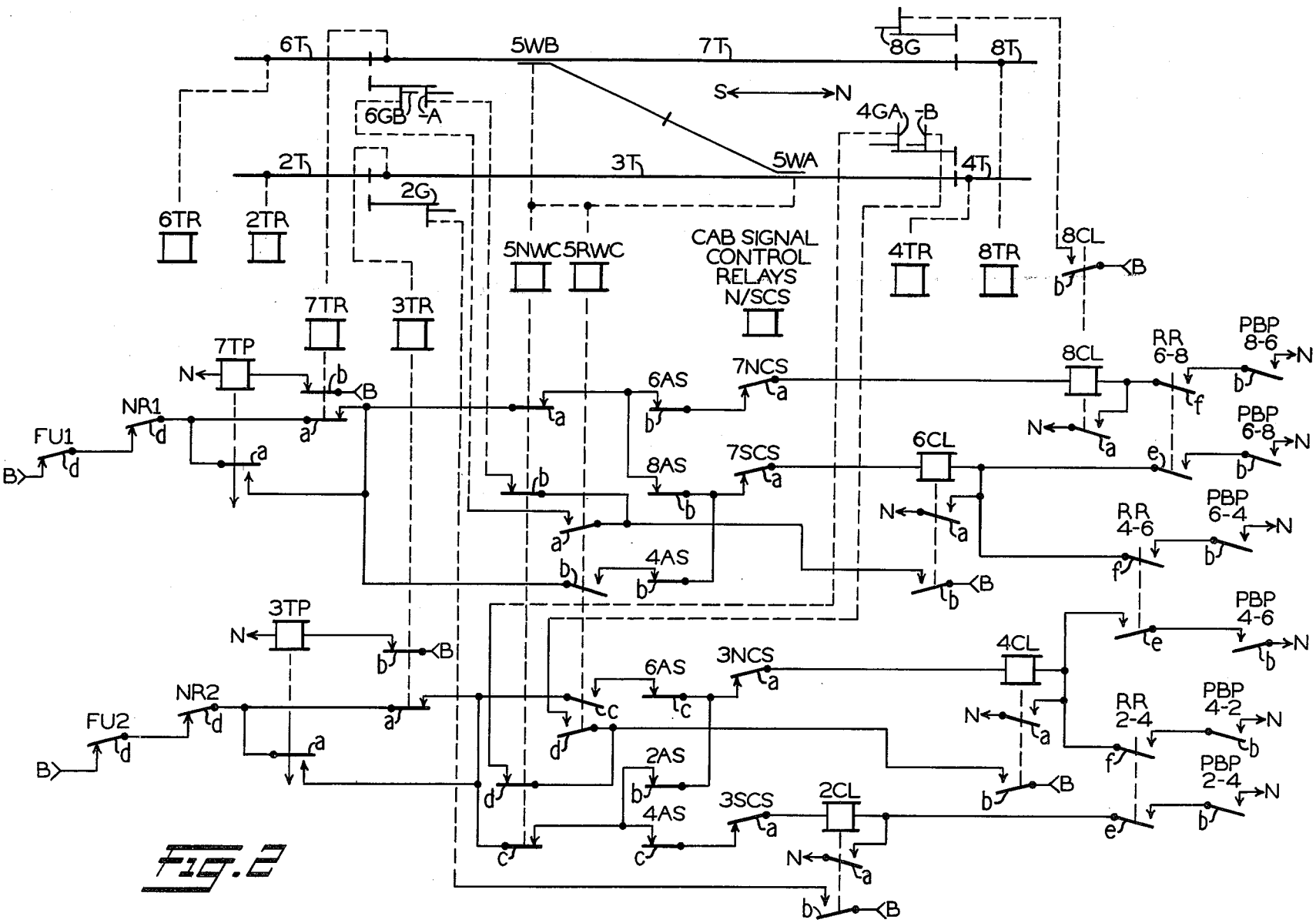
FIG. 2 is also, in part, a schematic diagram of a simple railroad interlocking, to which the invention is applied, showing the track circuits and signal locations, and with a circuit diagram portion illustrating the route locking and signal clearing circuits which cooperate with the route request circuits of FIG. 1.

Referring now to FIG. 2, across the top is a schematic diagram of the track layout within the interlocking, each track being designated by a conventional single line symbol. Two main tracks and a crossover connecting between them are illustrated, corresponding to the track diagram on the control machine (FIG. 1). This diagram also illustrates the track sections within and in approach to the interlocking limits, conventional symbols being used to designate the insulated joints which define the outer limits of the interlocking, separate the sections, and, at the middle of the crossover, insulate the one main track from the other. Thus in the lower track, there are shown the insulated track sections 2T, 3T, and 4T, 3T being within the limits of the interlocking. In the upper track are the track sections 6T, 7T, and 8T. Track sections 3T and 7T, which are within the interlocking limits, are normally defined as detector track sections while those track sections, shown only in part outside the joints designating the interlocking limits, are known as approach track sections. Because of the insulated joint midway in the crossover, a portion of this track is included in each of the detector track sections. Each illustrated track section is provided with a track circuit, although only the connections of the track relay to the rails are illustrated by a conventional dotted line. It may be assumed that the well known and conventional direct current track circuits are used in each section. The track relay is energized and in its picked up condition when no train is occupying any portion of the corresponding track section. For example, for detector track section 3T, including that portion of the crossover which is part of the detector track section, relay 3TR is picked up when this section is completely unoccupied by any train.

The two switches 5WA and 5WB which connect the crossover track to each of the main tracks are conventionally shown. These switches are positioned as required by the control apparatus in the manner to be discussed shortly. Two switch correspondence relays 5NWC and 5RWC are provided to check the actual switch position against that which is desired or designated by the control apparatus. In other words, one or the other of these relays is energized and picked up as the switches are respectively in their normal and reverse positions, if that actual position corresponds to that requested for the established route. Such correspondence relays are conventional in interlocking arrangements and the conventional dotted line indicates the control or check by apparatus as to the actual switch position. Obviously only one of these relays is properly picked up at a time. Thus when main track routes are lined, relay 5NWC is energized and picked up while relay 5RWC is energized when the switches assume their reverse positions when a route using the crossover has been established. As will be discussed further, no actual controls for the switch apparatus from the interlocking control equipment are shown since such control is conventional and it will be understood by those versed in the interlocking art.

Wayside signals are designated at each entry point into the interlocking by conventional symbols. Such signals are known as entry or home signals and when displaying a proceed indication authorize a train to pass that signal and enter the route established through the interlocking to move to the exit end and beyond. Since both signals 4G and 6G at locations 4 and 6, respectively, control either a main track or a crossover move, such signals are illustrated as two arm signals with the upper or A arm controlling the main line move and the lower or B arm controlling the move over the crossover. Signals 2G and 8G control only main line moves and thus a single arm only is illustrated. For convenience in the description, each of the signals is illustrated as a two position signal which displays either a proceed or a stop indication. Obviously more indications may be displayed by any of these signals, depending upon the advance traffic conditions, as may be desired by the complete and overall traffic control system.

FIG. 2 also illustrates the control circuit networks for the clear and lock relays CL, one of which is associated with each entry point into the interlocking. Each such CL relay checks that a requested route is clear and may be established, locks the route if such conditions exist, and enables the clearing of the corresponding entry signal. The clearing and locking of a route is initiated by the corresponding route request relay but it is the circuit for the entry relay CL which checks that the opposite direction cab signal has not been applied and that the opposite direction approach locking stick relay is not released to indicate the immediate approach of a train. The circuit for each relay CL also checks that proper switch positions exist, depending upon the route requested, and that the initial detector track section is clear. Provision is made in each CL relay circuit for cancellation of the route even though it has been established and the signal cleared.

Near the center of the FIG. 2 drawing, a single relay symbol represents the cab signal energy control relays for this interlocking which are generally designated by the reference CS with a prefix comprising a number corresponding to the detector section and a letter indicating the train direction. For purposes of this discussion, trains move in a north or south direction through the interlocking, northbound trains moving to the right. Thus, below the single relay winding designated N/SCS are four back contacts, each designated in accordance with the train direction and the track section associated therewith. The specific control circuits for the cab signal energy control relay CS are disclosed in a copending patent application filed Jan. 24, 1975 in the name of Kenneth G. Buzzard, Ser. No. 543696, for Cab Signal Control Circuits for Railroad Interlockings, the two copending applications having the same assignee. Very briefly, when a train authorized to move through the interlocking enters a detector track section, the detection of its occupancy causes the associated cab signal control relay for that direction to pick up to apply cab signal energy to the rails from the other end to actuate the cab signal or speed control equipment on the train. Thus, back contact *a* of relay 7NCS is opened in response to the entry of a train into section 7T moving in a northward direction past signal 6G. If this train is moving through the crossover, relay 3NCS will also be energized and pick up to open its back contact *a* when the train moves through the crossover so that continuous cab signal energy is applied. Reference is made to the cited copending application for a better understanding of this control circuitry and the relay operation, it being sufficient here to know that, as long as the back contacts of these CS relays are closed, no opposing train movement exists within the interlocking limits.

By way of example, a first circuit for relay 6CL can be traced from terminal B over back contact *d* of relay FU1, back contact *d* of relay NR1, front contact *a* of relay 7TR, front contact *a* of relay 5NWC, front contact *b* of approach lock relay 8AS, back contact *a* of relay 7SCS, the winding of relay 6CL, front contact *e* of relay RR6-8, and front contact *b* of relay PBP6-8 to terminal N. This circuit is effective, of course, when a route request for a move from signal 6 to exit location 8 has been registered and the various track and cab signal energy conditions are proper. When relay 6CL picks up, its front contact *a* completes a stick circuit to terminal N which bypasses the front contacts of relays RR6-8 and PBP6-8. It is also to be noted that it is front contact *b* of relay PBP6-8 which determines or designates that the route direction is from 6 to 8 and that relay 8CL is not to be energized by this route request. The second circuit for relay 6CL, if the requested route is from location 6 to location 4, includes the previously mentioned contacts *d* of relays FU1 and NR1 and front contact *a* of relay 7TR, thence brancing over front contact *b* of relay 5RWC, since the crossover switches must be reversed, front contact *b* of approach lock relay 4AS, the previously mentioned back contact *a* of relay 7SCS, and the winding of relay 6CL, thence extending over front contact *f* of relay RR4-6 and *b* of relay PBP6-4. The latter two contacts are then bypassed by the stick circuit of relay 6CL which locks up the established route and holds the route locked until it is cancelled or a train accepts the cleared signal as will be shortly described.

The stick circuit for relay 6CL is interrupted when track section 7T is occupied so that relay 7TR releases to open its front contact *a*. Relay 7TR is supplied with a front contact repeater relay 7TP which is normally energized over the obvious circuit including front contact *b* of relay 7TR. Relay 7TP is also deenergized when section 7T is occupied but, having slow release characteristics as indicated by the downward pointing arrow at its contact *a*, holds back contact *a* open for a predetermined period after the relay winding is deenergized. The closing of this back contact *a* of relay 7TP eventually bypasses the open front contact *a* of relay 7TR so that relay 6CL may be reenergized for a call-on train movement while the interlocking route is still occupied. This is a restricted speed train movement to close up upon the preceding train occupying the advance track section. Relay 6CL is also deenergized if either of the cancellation relays FU1 or NR1 is energized and picks up to open the corresponding back contact *d*. It is to be noted that relays RR6-8 and PBP8-6 may be energized, while a first train moving from location 6 to location 4 is occupying the interlocking, and thus store a new route request. However, relay 8CL cannot be energized, even though back contact *a* of relay 7TP is closed, since the circuit for relay 8CL will be open at front contact *a* of relay 5NWC and also for a time at back contact *a* of relay 7NCS. A similar circuit network also controls relays 4CL and 2CL but since the operation of this network will be obvious by reference to the preceding description and the circuit diagrams, a full explanation is not herein included.

Each CL relay prepares a circuit for clearing the corresponding signal when a route is locked up. Such circuits check as appropriate the switch position to select the proper entry signal for the established route. For example, when relay 6CL is energized to lock up a route from 6 to 8, the circuit is prepared for eventually clearing signal 6GA which includes front contact *b* of relay 6CL and front contact *b* of relay 5NWC. If the crossover is reversed so that relay 6CL is locking up a route from location 6 to location 4, the signal preparation circuit includes front contact *b* of relay 6CL as before but now front contact *a* of relay 5RWC and thus prepares the circuit for signal 6GB. In each of these circuits prepared by relay 6CL at its front contact *b*, the dotted portion beyond the front contact of the switch correspondence relay designates, in a conventional manner, the usual advance traffic and track section occupancy checks which are necessary in order that the proper proceed indication will be displayed on the corresponding signal. Relay 8CL controls directly the single arm of signal 8G, no selection by contacts of the switch correspondence relays being required although a safety check of the locked up normal switch position would be included in the conventional part of the signal circuit. Similar circuit networks for signals 4GA and 4GB for routes entering at location 4 and the single circuit for signal 2G are controlled, respectively, by relays 4CL and 2CL in a similar manner.

Figure 3:
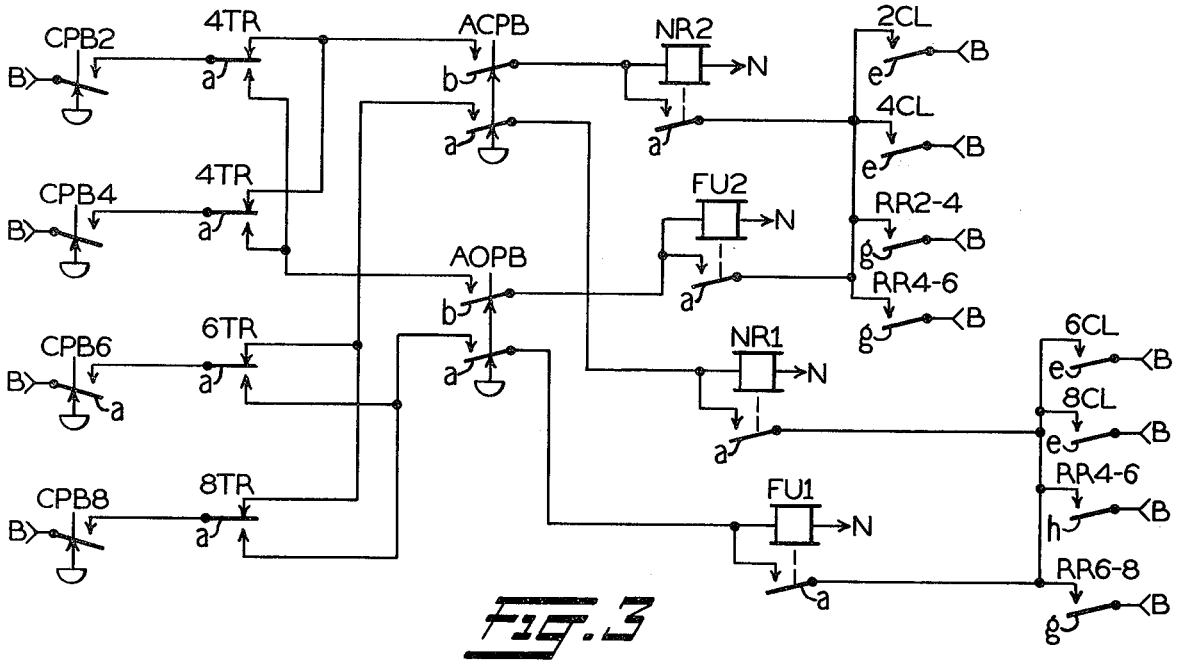
FIG. 3 is a circuit diagram of the route cancellation control network which is part of the inventive system illustrated in the other drawings.

Turning now to FIG. 3, the route cancellation relays and their control circuits are shown in circuit diagram arrangement. As previously indicated, there are two types of cancellation relays with the relays NR being used to cancel routes when track sections in approach to the route entrance are unoccupied by any approaching train. Conversely, the cancellation relays FU are used to cancel routes when these approach track sections are occupied by an approaching train. Two pairs of such relays exist, one for each of the main tracks. It will be noted, of course, in FIG. 1, that all four relays are involved in the cancellation arrangement for route request relay RR4-6 which, involving the crossover in either direction, also involves portions of each main track. One reason for separating the cancellation proceedings depending upon these two approach conditions is so that, if desired, a record can be made of the number of times that a route is cancelled or taken away while the train for which it was originally established is already in the approach track section.

At the left of FIG. 3 is a column of conventional spring return push button symbols which correspond to the block form of push buttons shown in the upper right of FIG. 1 in the vertical column under the CANCEL notation. Each of these cancel push buttons CPB, with a numerical suffix corresponding to the route entry point, is of the conventional spring return type whose single normally open contact is closed only when the push button is actuated. In the center of this drawing figure are two similar symbols designating the general cancellation push buttons ACPB and AOPB, corresponding to the approach clear and approach occupied conditions, respectively. Each of these spring return push buttons has two normally open contacts which are closed simultaneously when the push button is actuated. As previously indicated, cancellation of a route, when established or during the time when it is being requested, requires the operation not only of the push button corresponding to the entry point but one or the other of the common push buttons depending upon the condition of the approach track section.

If a route from location 6 to location 4 is being established or is already established so that relay 6CL is picked up, a circuit for energizing relay NR1 to cancel this route when the approach track section 6T is unoccupied is traced from terminal B over contact *a* of push button CPB6, which will be closed to actuate a cancellation action, front contact *a* of relay 6TR, since the corresponding track section is not occupied, contact *a* of push button ACPB, closed also in actuating the cancellation action, and through the winding of relay NR1 to terminal N. The closing of front contact *a* of relay NR1 establishes a stick circuit for holding this relay energized, when the push buttons are released, which is supplied from terminal B, under the assumed circumstances, over front contact *h* of relay RR4-6 or front contact *e* of relay 6CL. It will be noted that other parallel connections to terminal B for this same relay stick circuit may be completed over front contact *e* of relay 8CL or front contact *g* of relay RR6-8 so that relay NR1 is effective to cancel routes other than the one previously assumed.

If track section 6T is already occupied so that relay 6TR has released, the circuit beginning at contact *a* of push button CPB6 extends over back contact *a* of relay 6TR, contact *a* of push button AOPB, which will be the one actuated under the existing track occupancy conditions, and the winding of relay FU1 to terminal N. When this relay picks up, its front contact *a* completes a stick circuit which has the same possible sources of energy as that described for relay NR1, the stick circuit arrangement being common for either cancellation relay of this pair. If cancel push button CPB8 is involved with an established route entering at location 8, either relay NR1 or FU1 is also energized, the circuits differing only in including front or back contact *a* of relay 8TR, respectively. Similar circuits exist for cancellation relays NR2 and FU2 involving contacts of cancel push buttons CPB2 and CPB4, contacts of track relays 2TR and 4TR, and the other contact *b* on the common push buttons ACPB and AOPB. The operation of these circuits will be obvious from an inspection of the circuit diagram of FIG. 3 when taken in connection with the previous description. It is to be noted that relays NR2 and FU2 have a common stick circuit arrangement including, in multiple, front contacts of relays 2CL, 4CL, RR2-4, and RR4-6.

Figure 4:
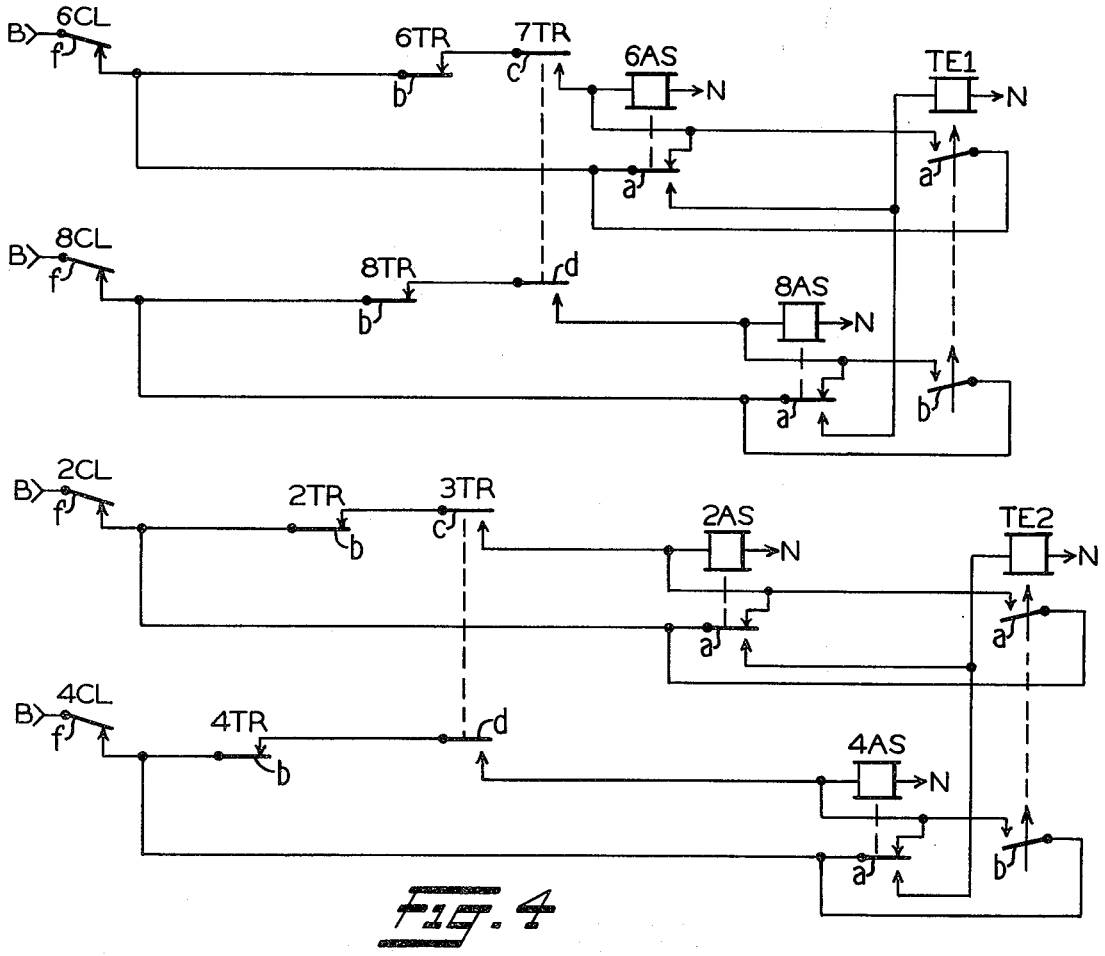
FIG. 4 is a circuit diagram of the approach locking circuits for the route interlocking control system of FIGS. 1 and 2.

In FIG. 4 are illustrated the circuit networks for the approach lock relays AS. There is one such relay for each of the approach track sections to the illustrated interlocking, each specifically designated by a corresponding numerical prefix. Each AS relay is normally energized by a stick circuit. For example, this stick circuit for relay 6AS, completed at its own front contact *a*, further includes back contact *f* of relay 6CL. When a route is cleared and locked up and a proceed signal therefore enabled, the corresponding AS relay releases. In this specific example, when relay 6CL picks up to clear and lock a route originating at location 6, relay 6AS is deenergized because its stick circuit is opened and this relay releases. Once released, an AS relay may be reenergized and picked up in one of two ways. Normally this is accomplished by the passage of a train past the proceed signal into the interlocking and the clearing of the approach track section. The second manner includes a time delay period and is used if the operator cancels, that is, releases, the route and thus returns a proceed signal to stop. For example, relay 6AS is reenergized when the circuit including back contact *f* of relay 6CL, front contact *b* of relay 6TR, and back contact *c* of relay 7TR is completed. This occurs when a train authorized to enter the interlocking at location 6 has proceeded past signal 6G to occupy section 7T and has cleared the approach track section 6T. As was previously described, when relay 7TR releases upon occupancy of the corresponding section, relay 6CL is also deenergized and releases. When relay 6AS, thus energized, picks up, it completes its previously traced stick circuit. It will be noted that the energization of relay 6AS thus occurs only when the train is still occupying the detector track section but has cleared the approach track section at the location at which it enters the interlocking.

When a route is cancelled and a proceed signal is taken away, the time delay period required for resetting the approach lock relays involves one or the other of the time element relays TE1 and TE2. Each of these relays is of the type which provides a delay period between the time of energizing the relay winding and the closing of its front contacts. This period may be on the order of one or a few seconds up to as much as a minute or more in elapsed time. The delay period is normally preset and adjusted in accordance with the requirements of the particular arrangement in which used. If a route entering the interlocking at location 6 is cancelled so that relay 6CL is released, the closing of its back contact *f* completes the circuit for energizing relay TE1, this circuit further including back contact *a* of relay 6AS and the winding of relay TE1. At the expiration of the preset timing period for time element relay TE1, its front contact *a* closes to complete a circuit which bypasses the contacts of track relays 6TR and 7TR in the usual energizing circuit for the winding of relay 6AS. This latter relay, thus energized over the time element relay front contact, picks up and completes its stick circuit in the usual manner. The opening of back contact *a* or relay 6As deenergizes relay TE1 which releases. When relay 6AS picks up, it closes front contacts in various clear and lock relay circuit networks shown in FIG. 2 in order to allow the clearing and locking of a route other than that originally established.

Actually the time delay provided by relay TE1 will be selected to allow an approaching train to stop short of signal 6G when this signal is taken away and the route cancelled, or to allow the train to overrun the signal, if insufficient space remains for the train to stop, and occupy section 7T without any danger to any conflicting movements. In other words, once a route is established and the entering signal cleared, the cancellation of the route and the taking away of the signal cannot allow its immediate replacement by another established route and clear signal until any train approaching the original proceed signal has had time to stop, either clear of or occupying the interlocking so that no unsafe condition exists. Similar circuit networks, of course, are provided for the other approach lock relays 8AS, 2AS, and 4AS, each including the appropriate contacts of approach and detector track relays and the clear and lock relays. It will be noted that relay TE1 has a second front contact *b* which is involved in the time delay pickup for relay 8AS whereas relay TE2 controls the time delay pickup for the approach lock relays 2AS and 4AS for the other main track.

I shall now describe the operation of the apparatus when establishing a route for a train to move through the interlocking and for the reset after the train occupies and then clears the various track sections. For purposes of the description, it is assumed that a train approaches the interlocking along the upper track through approach section 6T and that this train is to be transferred over the crossover to the lower track and to recede from the interlocking through section 4T. The interlocking operator actuates route push button RPB6-4 shown in FIG. 1. Since all track conditions and other associated apparatus are considered to be in a normal position, as illustrated, the closing of contact *a* on push button RPB6-4 completes the circuit for energizing route request relay RR4-6. The circuit also includes back contacts *d* of relays 4CL and 6CL to check that no other traffic route is presently established which is the same as or opposes the desired route, i.e., uses the same track route. Back contacts *c*, in series, of all the cancellation relays check that no cancellation is in progress. The circuit also includes back contacts *c* of the other route request relays to assure that simultaneous action for conflicting routes is not occurring. Relay RR4-6, thus energized, picks up and completes its stick circuit at its front contact *a* which bypasses the contact of the route push button so that it may now be released. Contact *b* of push button RPB6-4, when closed, energizes repeater relay PBP6-4 which closes its front contact *a* to complete a stick circuit also including front contact *b* of relay RR4-6. The stick circuit for relay PBP6-4 assures that this relay remains energized to record the traffic direction desired through the requested route. Thus, upon the release of push button RPB6-4, the route request and the direction of movement remain registered in the apparatus through the provision of the stick circuits. This route registry may be indicated in the track diagram shown in the upper left of FIG. 1 by some distinctive indication, normally flashing lights along the desired route. However, since these indications are relatively conventional and well known, the specific circuits for controlling the lights are not shown.

Assuming that the crossover switches, as controlled by the route request, have positioned to line the route through the crossover, that is, the switches have been moved to their reverse positions, a circuit is then completed for energizing clear and lock relay 6CL. It will be remembered that, when the switches reverse their position, relay 5RWC becomes energized as soon as both switches occupy their reverse positions, as that corresponds to that position requested, while normally energized relay 5NWC releases since the switches are no longer normal. The circuit for relay 6CL then includes, as previously traced, front contact *a* of relay 7TR, front contact *b* of relay 5RWC, front contact *b* of relay 4AS which indicates that the opposing route is not cleared and locked nor its entry signal cleared, back contact *a* of relay 7SCS to assure that no southbound cab signal energy has been applied, and front contacts *f* and *b* of relays RR4-6 and PBP6-4, respectively, to check the route request and traffic direction.

Relay 6CL picks up, completing a stick circuit at its front contact *a* which bypasses the circuit path over front contact *f* of relay RR4-6 and front contact *b* of relay PBP6-4. The opening of back contact *d* of relay 6CL interrupts the stick circuit for relay RR4-6 and this relay shortly releases. This release is slowed by the diode snub on the winding of relay RR4-6 so that relay 6CL will have time to complete its pickup action before front contact *f* of relay RR4-6 opens. Relay PBP6-4 is then deenergized and also releases. The closing of front contact *b* of relay 6CL with front contact *a* of relay 5RWC already closed enables or prepares the circuit for clearing signal 6GB. The corresponding opening of back contact *f* of relay 6CL interrupts the previously described stick circuit for approach lock relay 6AS which now releases. This completes the establishment and lockup of a desired route from location 6 to location 4 and enables the clearing of the corresponding signal in accordance with the advance traffic conditions recorded in the conventional portions of the signal control circuit. The release of relay 6AS also interrupts the circuit for relay 8CL and the circuit over front contact *c* of relay 5RWC by which relay 4CL might be energized. Thus release of approach lock relay 6AS prevents the clearing of any opposing signal to signal 6GB which is now displaying a proceed indication.

With the approaching train in section 6T, relay 6TR releases and its front contact *b* further interrupts the pickup circuit for relay 6AS. When this train accepts and passes signal 6GB displaying a proceed indication and occupies section 7T, relay 7TR releases. The opening of front contact *a* of this latter relay interrupts the stick circuit for relay 6CL which also releases. Obviously relay 7TP is deenergized when front contact *b* of relay 7TR opens. This repeater relay, having slow release characteristics, holds its back contact *a* open for a brief period. When this delay period has expired, the closing of back contact *a* of relay 7TP will allow the operator to request a similar route and display a call-on indication at signal 6G so that a second train may close up if desired. As the train proceeds through the crossover into section 3T, relay 3TR releases, followed, at the end of a slow release period, by the release of relay 3TP. The release of relay 3TR has no real effect at this time on the circuits for relays 4CL and 2CL other than to further interrupt the pickup circuits. However, since back contact *a* of relay 3TP will shortly close, these additional circuit interruptions are of a relatively short duration.

When the rear of this train clears section 6T, relay 6TR picks up, closing its front contact *b* in one energizing circuit for relay 6AS. Since back contact *f* of relay 6CL and back contact *c* of relay 7TR are already closed, relay 6AS picks up and completes the usual stick circuit including back contact *f* of relay 6CL so that relay 6AS is restored to its normal condition. The closing of front contacts *b* and *c* of relay 6AS do not, however, complete any circuits for relays 8CL and 4CL, respectively, since such pickup circuits are open at other points. When the train clears section 7T so that relays 7TR and, shortly, 7TP pick up, the operator may then request, if desired, a new route from location 6 to 8 or in the opposite direction since the circuit for relay RR6-8 is now complete to the contacts of the associated push buttons RPB. Likewise, the circuits for 6CL and 8CL are now prepared, except for contacts of relay 5NWC, since relay 6AS is picked up and relay 7NCS has now released. When the train clears section 3T, that is, the rear end passes beyond signal 4G, relay 3TR and then relay 3TP pick up. The control system is now restored to normal, that is, no routes are established through the interlocking.

It is now assumed that, prior to the train for whom the route from location 6 to location 4 was established occupying section 6T, the route is to be cancelled for any one of various reasons. For example, it is desired to hold the train short of the interlocking or it is necessary to clear for another train to avoid its delay. The operator, knowing that section 6T is not occupied, activates cancel push buttons CPB6 and ACPB on the console. Referring to FIG. 3, this action closes the contacts *a* of these two push buttons and, since front contact *a* of relay 6TR is still closed, completes the circuit for energizing relay NR1. Relay NR1 picks up, closing its front contact *a* to complete a stick circuit which further includes at this time front contact *e* of relay 6CL. The opening of back contact *c* of relay NR1 interrupts the stick circuit for relay RR4-6 if the establishment of the route has proceeded no further than registry by this relay. If the route is established and locked, the opening of back contact *d* of relay NR1 interrupts the stick circuit for relay 6CL. Assuming that the route was completely established and relay 6CL energized, the opening of its stick circuit causes relay 6CL to release to cancel the route lockup and interrupt the circuit by which signal 6GB was held clear. Signal 6GB thus returns to its stop indication. Meanwhile, the closing of back contact *f* of relay 6CL completes the circuit, since back contact *a* of relay 6AS is also closed, to energize relay TE1. This relay begins to run its time period, at the close of which it picks up to close its front contact *a* and complete the alternate circuit for energizing relay 6AS. This latter relay picks up, completing its normal stick circuit, and holds. At this point, the interlocking is reset to its normal condition and another route may be established and another signal cleared with complete safety.

If section 6T is occupied by the approaching train when it is decided to cancel the route, the operator actuates push buttons CPB6 and AOPB. This completes the circuit at contacts *a* of these two push buttons over back contact *a* of relay 6TR for energizing relay FU1. This relay picks up, closing its front contact *a* to complete the stick circuit which at this point includes front contact *e* of relay 6CL. If the system is so designed, the pick up relay FU1 will register that a route has been cancelled and a signal taken away from an approaching train. The pick up of relay FU1 will interrupt, at its back contact *c*, the circuit for relay RR4-6, if not already released, and also, at its back contact *d*, the circuit for relay 6CL. As before described, the release of relay 6CL releases the route lock, interrupts the circuit holding the signal clear, and causes the energization of relay TE1. Relay 6As thus cannot pick up until its alternate circuit is completed by the closing of front contact *a* of relay TE1 at the end of the slow pickup period of this latter relay. This is particularly important, when a route is cancelled with the train already on the approach track section, since it prevents the establishment of another conflicting route and the clearing of another signal for a second train until the already approaching first train either stops short of the signal, here signal 6G now displaying stop, or overruns the signal because of insufficient stopping distance. Under this latter condition, the first train will have occupied section 7T and thus block the establishment of any other route prior to the time that relay 6AS picks up. This feature assures fail-safe operation of the interlocking control system.

During the time that the route from 6 to 4 is cleared and locked, that is, relay 6CL is picked up and relay 6AS is released, a route from 2 to 4 or from 4 to 2 may be stored by energizing route request relay RR2-4. This operation is initiated by actuating push button RPB2-4 or RPB4-2 to energize relay RR2-4. It is noted that the circuit includes back contacts *b* of relays FU2 and NR2, back contacts *c* of relays 4CL and 2CL which are both closed, back contact *c* of relay RR4-6 which is now closed since that route is locked up and route registry released, the winding of relay RR2-4, and either contact *a* of push button RPB2-4 or contact *a* of the opposite push button RPB4-2. In either case, relay RR2-4 picks up, closing its front contact *a* to complete a stick circuit which bypasses the contact of whichever push button was operated. Either relay PBP2-4 or PBP4-2 will also be energized and held by the obvious stick circuit. However, the energizing circuit for relay 2CL is presently open at front contact *c* of relay 5NWC since a crossover route is established and the switches are still in their reverse positions. One circuit for relay 4CL is open at the same front contact *c* of relay 5NWC while the reverse route circuit is open at front contact *c* of relay 6AS. Thus neither of the clear and lock relays can be energized at this time and, because of the stick circuit, relay RR2-4 remains picked up and the route request stored.

After this first train moves from location 6 to location 4 and clears the limits of the interlocking, relay 2CL, for example, can then pick up after the switches 5W position to their normal positions in response to the stored route request. Assuming that the train is waiting in section 2T, the circuit for relay 2CL will include back contacts *d* of the cancellation relays FU2 and NR2, front contact *a* of relay 3TR which closes as soon as the first train clears the interlocking limits, front contact *c* of relay 5NWC closed as soon as the switches are positioned normal, front contact *c* of relay 4AS, closed since signal 4G is not cleared and relay 4CL is not picked up, and back contact *a* of relay 3SCS since no cab signal energy is being applied for a southbound train move. The circuit is completed over front contact *e* of relay RR2-4 and front contact *b* of relay PBP2-4. The stick circuit for relay 2CL is completed when front contact *a* of that relay closes, bypassing the latter two contacts of the route request and push button repeater relays in the usual manner. The pick up of relay 2CL opens its back contact *f* to release relay 2AS and prepares a circuit at its front contact *b* for signal 2G. The aspect displayed by signal 2G will depend upon the traffic conditions in advance of section 3T, that is, the location of the preceding train. It is to be noted, however, that only a route that is partially conflicting with an established route and primarily originating in the other of the two main tracks can be requested and stored. Parallel routes can be simultaneously established at any time.

An arrangement embodying my invention this provides an improved route interlocking control system. This improved system requires only a single route request relay for each possible track route or lineup through the interlocking, supplemented by a pair of traffic direction relays, one to designate each traffic direction along that route. At the same time, a single clear and lock relay only is required at each entrance point to the interlocking. This relay checks each possible traffic route that can be requested from that entry point to determine if it is clear and may be established, to then lock up the route, and to enable the operation of the proper entry signal to permit the movement of a train. These operations are done in an efficient manner and with economy due to fewer number of required relays while at the same time safety of the system is not sacrificed.

Although I have herein shown and described but a single specific route interlocking control system embodying the arrangement of my invention, it is to be understood that various changes and modifications therein within the scope of the appended claims may be made without departing from the spirit and scope of my invention.

Having now described the invention what I claim as new and desire to secure by letters patent, is:

1. A route control system for a railroad interlocking, which interlocking comprises a plurality of track routes within prefixed outer limits selectable for train movements, each track route including one or more track sections each with a train occupancy detector, comprising in combination, a. a single route request means for each track route operable for registering a traffic route request for either direction of traffic through the corresponding track route, b. a control network for each route request means operable for selecting one or the other traffic direction through the associated track route and connected for operating the associated route request means to register the traffic route request, c. a direction registry means for each track route controlled by said control network for operating to a first or a second condition as said one or the other traffic direction through the associated track route is requested, d. a route locking means associated with each entry point of said interlocking and coupled for locking, when activated any requested traffic route originating at that point, and e. an activating circuit network for each route locking means controlled by each associated route request means, the corresponding direction registry means, said occupany detectors, and opposing route locking means for activating the associated locking means when an originating traffic route request is registered, the corresponding track route sections are unoccupied, and no opposing traffic route is established.

2. A route control system as defined in claim 1 in which, a. each route request means coupled for initiating the establishment of the corresponding track route when a route request is registered, and b. each route locking means also coupled for selecting, when activated, a control circuit to enable the display of a signal indication in accordance with the associated locked traffic route to authorize a train to traverse the established traffic route.

3. A route control system as defined in claim 2 in which each control network is further controlled by, a. the route locking means for both the requested traffic route and the opposite traffic route through the corresponding track route, and b. the route request means for each conflicting track route, c. each control network being inhibited from operating the associated route request means to register a traffic route request when the same or the opposite traffic route is established or a conflicting route request exists.

4. A route control system as defined in claim 3 in which each control network comprises, a. a circuit controller device for each direction of traffic through the associated track route, selectively operable to close at least two different circuit paths when a traffic route request is a activated, b. a first circuit network including in multiple a first circuit path of each associated circuit controller device and connected for operating the associated single route request means to register a traffic route request for either direction, and c. a second circuit network including a second circuit path of each associated circuit controllers, further controlled by the corresponding route request means, and connected to the associated direction registry means for registering and holding the selected traffic direction for the registered route request, d. each first circuit network also including contacts controlled by the route locking means for the traffic routes selected by the associated circuit controllers and by the route request means for each conflicting route for inhibiting the registry of a route request if either traffic route is already locked or if a conflicting route request is registered.

5. A route control system as defined in claim 4 in which, each first circuit nework further includes a stick circuit path controlled by the associated route request means for holding a registered traffic route request when the associated circuit controller is deactivated until the corresponding traffic route can be locked.

6. A route control system as defined in claim 5 in which, a. each route request means is a single route request relay controlled by the associated first circuit network and energized to register a traffic route request through the corresponding track route, b. each direction registry means comprises a pair of relays, one for each traffic direction through the associated track route and singly energized by the associated second circuit network as one or the other traffic direction is requested, c. each route locking means is a single relay energized to lock each traffic route originating at the corresponding entry point, and d. the activating circuit network for energizing each route locking relay includes, 1. a contact closed when the corresponding track route is completed,
2. an occupancy detector contact closed when the first section of the track route is unoccupied,
3. another occupancy detector contact closed when other portions of the track route are unoccupied, and
4. multiple circuit paths each comprising a contact closed when a traffic route request originating at that entry point is registered and a contact closed by the corresponding direction registry relay.

7. A route control system as defined in claim 3 which further includes, a. a circuit controller device for each traffic route, selectively operable to enable preselected circuit connections, b. each circuit controller coupled by one of its associated circuit connections for enabling the control network of the corresponding single route request means to register the request for the track route required by the selected traffic route, c. each circuit controller also coupled by another of its associated circuit connections to the corresponding control network for enabling the registry of the selected traffic direction through the registered requested route.

8. A route control system as defined in claim 3 which further includes, a. an approach lock means associated with each track section in approach to each interlocking entry point, coupled for registering the locking of a traffic route through said interlocking originating at that entry point, each approach lock means responsive to the entry of train onto said route for restoring to its non-registering condition, b. each approach lock means coupled into the activating circuit for the route locking means associated with each traffic route exiting the interlocking at the entry point corresponding to that particular approach lock means, for inhibiting the locking of an opposing traffic route when said particular approach lock means is registering the locking of a route originating at said particular entry point.

9. In a control system for a railroad interlocking which includes a plurality of different track routes, each route including one or more train detector sections with train occupancy detector means, the combination comprising, a. a single route request relay for each of said track routes through said interlocking, b. a pair of direction registry relays associated with each route request relay, one for registering each traffic direction along the corresponding track route, c. a selector means for each traffic direction along each track route operable to select a desired traffic route through said interlocking, d. a route registry circuit network coupled to each route request relay and controlled by the selector means for each traffic direction along the corresponding track route for actuating the associated route request relay to register and store a route request to establish the coresponding track route in the selected direction when no other conflicting route request relay is actuated, e. a direction registry circuit network controlled by each selector means and coupled to the corresponding direction registry relays for actuating the registry of the desired direction of traffic through the corresponding track route, f. a single clear and lock relay at each entry point into said interlocking coupled for locking, when activated, any requested and established traffic route through said interlocking originating at the corresponding point, and g. a control circuit network for each clear and lock relay controlled by said route request relays, other clear and lock relays, and preselected train occupancy detector means for activating the associated clear and lock relay when a corresponding route request is registered, no conflicting route is locked, the selected route is established, and no train is detected by said selected occupancy detector means.

10. An interlocking control system combination as defined in claim 9 in which, a. each route request relay is also coupled to the interlocking control system for initiating, when actuated, the establishment of the corresponding track route, b. each clear and lock relay is further coupled for enabling the control of an associated entry signal selected in accordance with the established route to authorize a train movement through the established traffic route.

11. An interlocking control system combination as defined in claim 10 in which, each route registry circuit network is also controlled by the clear and lock relays corresponding to each entry point of the associated track route and by selected other route request relays corresponding to conflicting routes for inhibiting the registry of a route request if the same or the opposing route is already locked or a request for a conflicting route is registered.

12. An interlocking control system combination as defined in claim 11 in which, a. each selector means is a circuit controller operable for closing at least two circuit paths when actuated, b. each route request circuit network includes in multiple a first circuit path of the selector circuit controller for each traffic direction in the corresponding route for enabling the registry of a route request when either circuit controller is actuated, c. each route request circuit network also includes a stick circuit path bypassing said circuit controller circuit paths for holding a route request registry after a circuit controller becomes non-actuated, d. each direction relay is controlled by a second circuit path of the selector circuit controller corresponding to the traffic direction registered by that relay, and e. each direction relay is held actuated by a stick circuit controlled by the associated route request relay for retaining a traffic direction registry while the route request is registered.

13. An interlocking control system combination as defined in claim 12 which further includes, a. a route cancellation controller associated with each entry point of said interlocking and operable to an active condition for initiating a cancellation of each route originating from that entry point, b. each cancellation controller coupled to the route request network for each route originating at the associated entry point for interrupting, when activated, a route request registry prior to the locking of that route, c. each cancellation controller also coupled to the control circuit network for the clear and lock relay associated with that entry point for cancelling when activated any route locked by that relay.

14. An interlocking control system combination as defined in claim 13 in which each clear and lock relay control circuit network includes, a. a detector contact closed when the initial track section along the requested route is unoccupied, b. a train responsive contact closed when other sections of said requested route are also unoccupied, c. a contact closed only when the associated track route is complete, d. a contact closed when the associated cancellation controller is non-activated, e. one or more circuit paths in multiple, each including, 1. a contact closed when a route request involving a track route from that entry point is registered, 2. a contact closed when the registered traffic direction designates a traffic route originating at the associated entry point, and f. a stick circuit path connected to bypass the multiple circuit paths for holding the route locked when the route request registry is terminated by the locking action.

* * * * *